US011325165B2

(12) United States Patent
Hu

(10) Patent No.: US 11,325,165 B2
(45) Date of Patent: May 10, 2022

(54) ION-BAR STRUCTURE WITH SELF-CLEANING FUNCTION

(71) Applicant: WUHAN CHINA STAR OPTOELECTRONICS TECHNOLOGY CO., LTD., Hubei (CN)

(72) Inventor: Chuwei Hu, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 462 days.

(21) Appl. No.: 16/472,644

(22) PCT Filed: Mar. 20, 2019

(86) PCT No.: PCT/CN2019/078810
§ 371 (c)(1),
(2) Date: Jun. 21, 2019

(87) PCT Pub. No.: WO2020/052212
PCT Pub. Date: Mar. 19, 2020

(65) Prior Publication Data

US 2021/0368608 A1 Nov. 25, 2021

(30) Foreign Application Priority Data

Sep. 11, 2018 (CN) ..... 201811058293.3

(51) Int. Cl.

| | |
|---|---|
| ***B08B 1/00*** | (2006.01) |
| ***B08B 1/04*** | (2006.01) |
| ***H05F 3/06*** | (2006.01) |
| *B08B 13/00* | (2006.01) |

(52) U.S. Cl.
CPC ..... *B08B 1/002* (2013.01); *B08B 1/04* (2013.01); *H05F 3/06* (2013.01); *B08B 13/00* (2013.01)

(58) Field of Classification Search
CPC combination set(s) only.
See application file for complete search history.

(56) References Cited

U.S. PATENT DOCUMENTS

2006/0029446 A1* 2/2006 Shyu ..... G03G 15/6558 399/390
2007/0292178 A1* 12/2007 Iwasaki ..... G03G 21/0058 399/357
2013/0097790 A1* 4/2013 Liao ..... E04G 23/002 15/88.4
2014/0044448 A1* 2/2014 Fukuda ..... G03G 15/0258 399/100

FOREIGN PATENT DOCUMENTS

JP 2009-158413 * 7/2009 ..... H01T 19/04

OTHER PUBLICATIONS

Machine translation of JP2009158413A (Year: 2009).*

* cited by examiner

*Primary Examiner* — Erin F Bergner

(57) ABSTRACT

The present disclosure provides an ion-bar structure with a self-cleaning function including an ion-bar body, a slide assembly, and a brush assembly. The ion-bar body has a slide track disposed along its own axis. The slide assembly is movably disposed on the slide track. The brush assembly is connected to the slide assembly for moving with the slide assembly. The brush assembly is contacted with a bottom side of the ion-bar body.

18 Claims, 2 Drawing Sheets

ION-BAR STRUCTURE WITH SELF-CLEANING FUNCTION

FIELD OF INVENTION

The present application relates to the field of static elimination, and in particular to an ion-bar structure with a self-cleaning function.

BACKGROUND OF INVENTION

In current production process of washing machines, static elimination of glass is carried out by an ion bar. The static elimination mainly relies on the tip discharging performed by a tip of the ion bar. During monthly maintenance, on-site employees discover particles accumulated at the tip of a discharging needle during operation, during monthly maintenance. If the static elimination efficiency of the ion bar is measured without cleaning, static elimination efficiency of the ion bar cannot meet static eliminating electricity standards. Because the ion bar cleaning only can be performed during monthly maintenance (once a month), the particles accumulated on the tip of needle cannot be cleaned in time. The static elimination efficiency of the ion bar is affected.

Therefore, the present technologies are in urgent need of improvement.

The present disclosure provides an ion-bar structure with self-cleaning function which can automatically clean the bottom of the ion-bar body to avoid excessive accumulation of dust.

SUMMARY OF INVENTION

The present disclosure provides an ion-bar structure with self-cleaning function includes an ion-bar body, a slide assembly, and a brush assembly.

A slide track is disposed on the ion-bar body along a direction of an shaft of the ion-bar body. The slide assembly is disposed on the slide track. The slide assembly can automatically slide along the slide track. The brush assembly is connected to the slide assembly in order to move with the slide assembly. The brush assembly is contacted with a bottom of the ion-bar body.

The slide track is disposed on a side wall of the ion-bar body.

In the ion-bar structure with self-cleaning function of the present disclosure, the brush assembly includes a first motor and a hairbrush.

The first motor is contacted and fixed with the slide assembly. The hairbrush is disposed on a rotation shaft of the first motor. Parts of edge of the hairbrush are contacted with the bottom of the ion-bar body.

In the ion-bar structure with self-cleaning function of the present disclosure, a shape of the hairbrush is round-disk.

In the ion-bar structure with self-cleaning function of the present disclosure, the hairbrush includes a first internal shaft, a flexible layer fixedly covering on the first internal shaft, a hair body covering on the flexible layer, and hairs disposed on the hair body.

In the ion-bar structure with self-cleaning function of the present disclosure further includes a dust-rid adhesive pad assembly disposed under the brush assembly.

In the ion-bar structure with self-cleaning function of the present disclosure, the dust-rid adhesive pad assembly includes a support and a dust-rid adhesive connected to the support. The support is connected to a shell of the first motor. The dust-rid adhesive pad locates under the hairbrush.

In the ion-bar structure with self-cleaning function of the present disclosure, the slide assembly includes a block, a wheel disposed at a bottom of the block, and a motor disposed on the block for driving the wheel roll. The wheel movably is locked on the slide track.

In the ion-bar structure with self-cleaning function of the present disclosure, the slide track is a chute slide track.

In the ion-bar structure with self-cleaning function of the present disclosure, the brush assembly includes a first motor, a hairbrush, and a flexible absorbing brush.

The first motor is contacted and fixed with the slide assembly. The flexible absorbing hair and the hairbrush are disposed on a rotation shaft of the first motor. The hairbrush is disposed at an outer side of the flexible absorbing brush. Parts of edge of the flexible absorbing brush and parts of edge of the hairbrush are contacted with the bottom of the ion-bar body.

In the ion-bar structure with self-cleaning function of the present disclosure, the flexible absorbing brush includes a second internal shaft and a sponge absorb layer covering the second internal shaft.

The present disclosure further provides an ion-bar structure with self-cleaning function including ion-bar body, slide assembly, and a brush assembly.

A slide track is disposed on the ion-bar body along a direction of a shaft of the ion-bar body. The slide assembly is disposed on the slide track. The slide assembly can automatically slide along the slide track. The brush assembly is connected to the slide assembly in order to move with the slide assembly. The brush assembly is contacted with a bottom of the ion-bar body.

The slide track is disposed on a side wall of the ion-bar body.

In the ion-bar structure with self-cleaning function of the present disclosure, the brush assembly includes a first motor and a hairbrush.

The first motor is contacted and fixed with the slide assembly. The hairbrush is disposed on a rotation shaft of the first motor. Parts of edge of the hairbrush are contacted with the bottom of the ion-bar body.

In the ion-bar structure with self-cleaning function of the present disclosure, a shape of the hairbrush is round-disk.

In the ion-bar structure with self-cleaning function of the present disclosure, the hairbrush includes a first internal shaft, a flexible layer fixedly covering on the first internal shaft, a hair body covering on the flexible layer, and hairs disposed on the hair body.

In the ion-bar structure with self-cleaning function of the present disclosure further includes a dust-rid adhesive pad assembly disposed under the brush assembly.

In the ion-bar structure with self-cleaning function of the present disclosure, the dust-rid adhesive pad assembly includes a support and a dust-rid adhesive connected to the support. The support is connected to a shell of the first motor. The dust-rid adhesive pad locates under the hairbrush.

In the ion-bar structure with self-cleaning function of the present disclosure, the slide assembly includes a block, a wheel disposed at a bottom of the block, and a motor disposed on the block for driving the wheel to roll. The wheel movably is locked on the slide track.

In the ion-bar structure with self-cleaning function of the present disclosure, the slide track is a chute slide track.

In the ion-bar structure with self-cleaning function of the present disclosure, the brush assembly includes a first motor, a hairbrush, and a flexible absorbing brush.

The first motor is contacted and fixed with the slide assembly. The flexible absorbing hair and the hairbrush are disposed on a rotation shaft of the first motor. The hairbrush is disposed at an outer side of the flexible absorbing brush. Parts of edge of the flexible absorbing brush and parts of edge of the hairbrush are contacted with the bottom of the ion-bar body.

In the ion-bar structure with self-cleaning function of the present disclosure, the flexible absorbing brush includes a second internal shaft and a sponge absorb layer covering the second internal shaft.

In the ion-bar structure with self-cleaning function of the present disclosure, the flexible absorbing brush includes a second internal shaft and a sponge absorb layer covering the second internal shaft.

The ion-bar structure with self-cleaning function of the present disclosure provides can automatically clean the bottom of the ion-bar body to avoid excessive accumulation of dust.

DESCRIPTION OF DRAWINGS

In order to clarify the technical solutions of embodiments of the present disclosure, the drawings required in the description of the embodiments will be briefly described below. Obviously, the drawings in the following description are only some embodiments of the present disclosure. Other drawings may be obtained by a skilled person in the art without any creative effort.

DETAILED DESCRIPTION OF PREFERRED EMBODIMENTS

Figure 1:
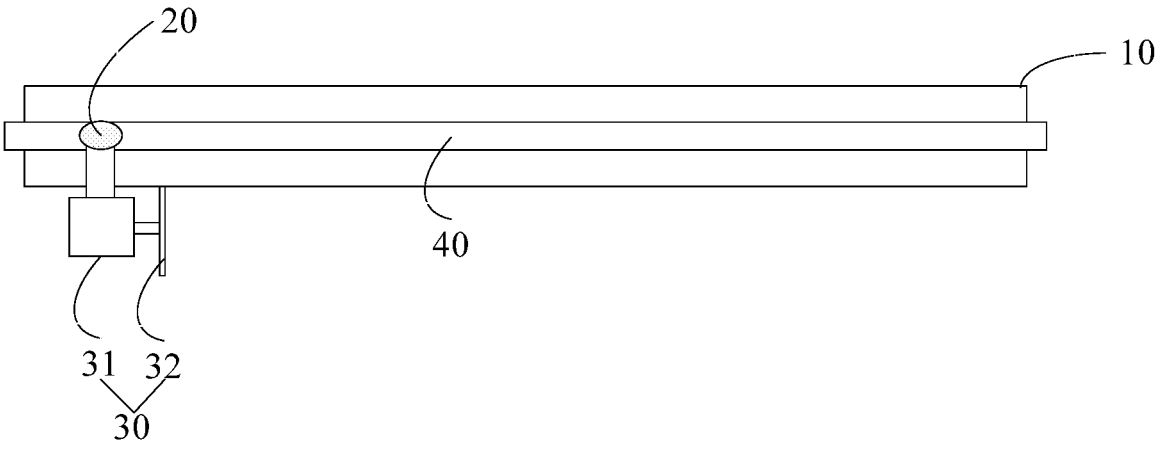
FIG. 1 illustrates a structure of an ion-bar structure with self-cleaning function of an embodiment of the present disclosure.

The technical solutions of embodiments will be clearly and completely described below accompanying with the drawings of the embodiments of the present disclosure. Obviously, the described embodiments are only a part of, not all of, the embodiments of the present disclosure. On the basis of the embodiments of the present disclosure, all other embodiments obtained by a skilled person in the art without creative efforts fall within the scope of the present disclosure.

It should be understood that in the description of the present disclosure, the terms, such as "center", "longitudinal", "transverse", "length", "width", "thickness", "upper", "lower", "front", "back", "left", "right", "vertical", "horizontal", "top", "bottom", "inside", "outside", "clockwise", "counterclockwise" etc., indicating the relationships of direction and position are utilized to clarify and simplify the present disclosure based on the orientation or positional relationship shown in the drawings. It is merely in the purpose of simply describing the present disclosure rather than indicating or suggesting precise directions, structures, and operations of the devices or assembly. Therefore, above-mentioned directional terms cannot be limitations of the present disclosure. Moreover, the terms "first" and "second" are only used for descriptive purposes rather than indicating or suggesting a relative importance or numbers of technical features. Thus, features including "first" or "second" may have one or more of the described features either explicitly or implicitly. In the description of the present disclosure, "a plurality" means two or more, unless specifically defined.

In the present disclosure, it should be noted that the terms "install", "connect", and "link" should be broadly understood as fixedly connect, separately connect, integrally connect, mechanically connect, electrically connect, communicate, directly connect, indirectly connected through an intermediate medium, internally communicate between two components, or mutually interact between two components, unless specifically defined. For a skilled person in the art, the specific meaning of the above terms of the present disclosure can be understood case-by-case practically.

In the present disclosure, the first feature is "on" or "under" the second feature may mean the first features is directly contacted with the second features, or the first features is indirectly contacted with the second features through another feature, unless specifically defined. Moreover, the first feature is "on", "above", or "upper" the second feature includes the first feature directly above or oblique above the second feature, or merely indicating that the level of the first feature is higher than the level of the second feature. The first feature is "below", "under", or "lower" the second feature includes the first feature directly below or oblique below the second feature, or merely level of the first feature being lower than the level of the second feature.

The following disclosure provides various embodiments and examples for implementing the different structures of the present disclosure. To simplify the disclosure of the present disclosure, the components and arrangement of particular examples are described below. Obviously, they are merely examples and are not intended to limit the present disclosure. In addition, the present disclosure may repeat reference numbers in different embodiment in the purpose of simplifying and clarifying between various embodiments. In addition, the present disclosure provides examples of various specific processes and materials, but a skill person in the art will recognize substitute processes and substitute materials.

Please refer to FIG. 1 which illustrates an ion-bar structure with a self-cleaning function of an embodiment of the present disclosure. The ion-bar structure with self-cleaning function includes an ion-bar body 10, a slide assembly 20, and a brush assembly 30.

A slide track 40 is disposed on the ion-bar body 10 along its own axial direction. The slide assembly 20 can automatically slid along the slide track 40 along which the slide assembly 20 disposed on. The brush assembly 30 is connected with the slide assembly 20 so that the brush assembly 30 can move with the slide assembly 20. The brush assembly 30 contacts with the bottom side of the ion-bar body 10 so that the brush assembly 30 can wipe off dust on the underside of the ion-bar body 10 when the slide assembly 30 moves.

The slide assembly 20 may include a block, a wheel disposed at the bottom of the block, and a motor disposed on the block for driving the wheel to roll. The wheel is movably attached to the slide track 40. The slide track 40 is a chute slide track.

In some embodiments, the slide track 40 may be a sliding shaft fixedly disposed on the ion-bar body 10. The slide assembly 20 is movably sleeved on the sliding shaft.

In some embodiments, the slide track 40 may be a chute disposed on a side wall surface of the ion-bar body 10. A portion of the slide assembly 20 is movably installed in the chute.

In some embodiments, the brush assembly 30 includes a first motor 31 and a hairbrush 32. The first motor 31 is fixedly connected with the slide assembly 20. The hairbrush 32 is disposed on a rotating shaft of the first motor 31. A partial side edge of the hairbrush 32 contacted with the bottom side of the ion-bar body 10.

A shape of the hairbrush 32 is round-disk.

Figure 2:
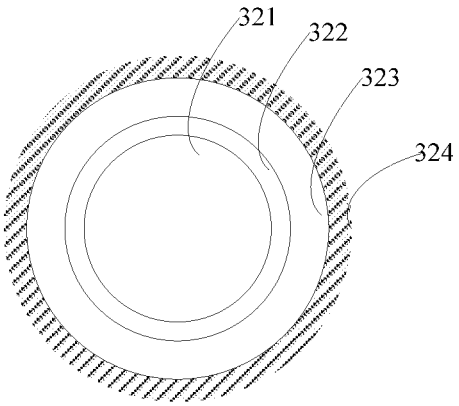
FIG. 2 illustrates a structure of a hairbrush of the ion-bar structure with self-cleaning function of an embodiment of the present disclosure.

Please refer to FIG. 2 which illustrates a hairbrush of the ion-bar structure with a self-cleaning function of the embodiment of the present disclosure. The hairbrush 32 includes a first internal shaft 321, a flexible layer 322 fixed on the first internal shaft 321, a hair body 323 fixed on the flexible layer 322, and a plurality of hairs 324 intensively disposed on the hair body. The first internal shaft 321 is coaxially fixed to the rotating shaft of the first motor 31. The flexible layer 322 is made of an elastic rubber layer. The hair body 323 is utilized to fix the plurality of hairs.

Figure 3:
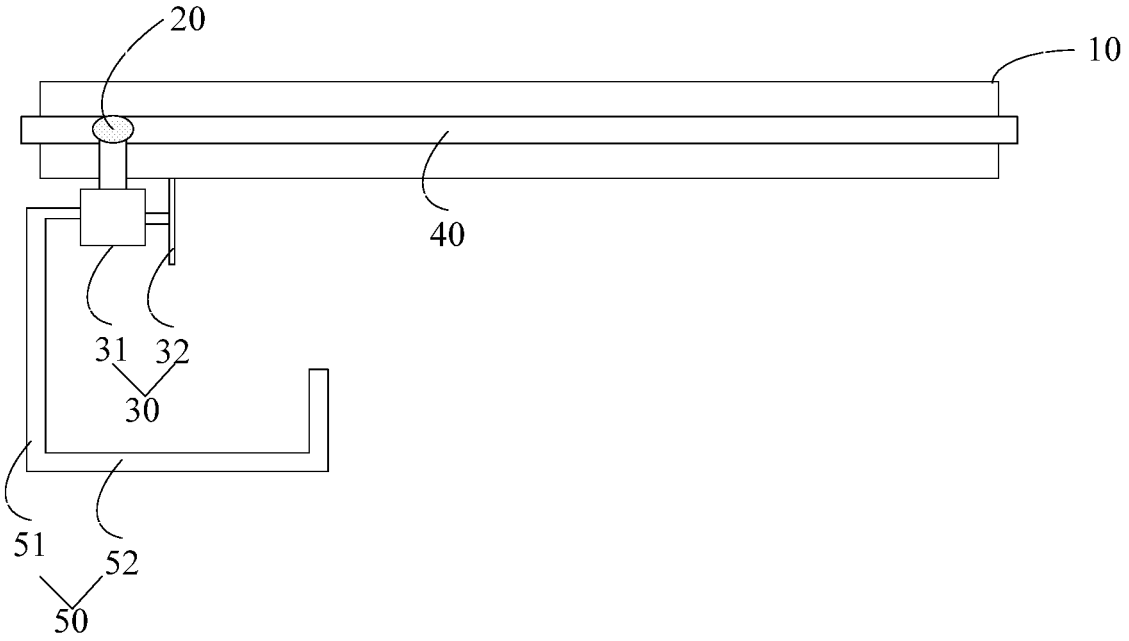
FIG. 3 illustrates another structure of an ion-bar structure with self-cleaning function of an embodiment of the present disclosure.

Please refer to FIG. 3 which illustrates another structure of an ion-bar structure with self-cleaning function in an embodiment of the present disclosure. In some embodiments, the ion-bar structure with self-cleaning function includes an ion-bar body 10, a slide assembly 20, a brush assembly 30, and a dust-rid adhesive pad assembly 50.

A slide track 40 is disposed on the ion-bar body 10 along its own axial direction. The slide assembly 20 can automatically slid along the slide track 40 along which the slide assembly 20 disposed on. The brush assembly 30 is connected with the slide assembly 20 so that the brush assembly 30 can move with the slide assembly 20. The brush assembly 30 contacts with the bottom side of the ion-bar body 10 so that the brush assembly 30 can wipe off dust on the underside of the ion-bar body 10 when the slide assembly 30 moves. The dust-rid adhesive pad assembly 50 is disposed under the brush assembly 30. The dust-rid adhesive pad assembly 50 includes a support 51 and a dust-rid adhesive 52 coupled to the support 51. The support 51 is fixed on the outer housing of the first motor. The dust pad 52 is located under the hairbrush. The dust-rid adhesive pad assembly 50 can move horizontally along the slide track 40 along with the brush assembly 30 to bar the dust ridded by the hairbrush 32.

The slide assembly 20 may include a block, a wheel disposed at the bottom of the block, and a motor disposed on the block for driving the wheel to roll. The wheel is movably attached to the slide track 40. The slide track 40 is a chute slide track.

In some embodiments, the slide track 40 may be a sliding shaft fixedly disposed on the ion-bar body 10. The slide assembly 20 is movably sleeved on the sliding shaft.

In some embodiments, the slide track 40 may be a chute disposed on a side wall surface of the ion-bar body 10. A portion of the slide assembly 20 is movably installed in the chute.

In some embodiments, the brush assembly 30 includes a first motor 31 and a hairbrush 32. The first motor 31 is fixedly connected with the slide assembly 20. The hairbrush 32 is disposed on a rotating shaft of the first motor 31. A partial side edge of the hairbrush 32 contacted with the bottom side of the ion-bar body 10.

A shape of the hairbrush 32 is round-disk.

Please refer to FIG. 2. The hairbrush 32 includes a first internal shaft 321, a flexible layer 322 fixed on the first internal shaft 321, a hair body 323 fixed on the flexible layer 322, and a plurality of hairs 324 intensively disposed on the hair body. The first internal shaft 321 is coaxially fixed to the rotating shaft of the first motor 31. The flexible layer 322 is made of an elastic rubber layer. The hair body 323 is utilized to fix the plurality of hairs.

Figure 4:
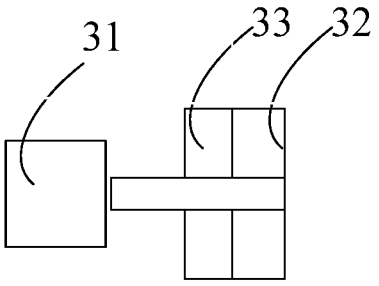
FIG. 4 illustrates another structure of a brush assembly with self-cleaning function of an embodiment of the present disclosure.

Please refer to FIG. 4 which illustrates another structure of a brush assembly with self-cleaning function in an embodiment of the present disclosure. In some embodiments, the brush assembly 30 includes a first motor 31, a hairbrush 32, and a flexible absorbing brush 33. The first motor 31 is fixedly coupled to the slide assembly. The flexible absorbing brush 33 and the hairbrush 32 are disposed on the rotating shaft of the first motor 31. The hairbrush 32 is located on outer side the flexible absorbing brush 33. The flexible absorbing brush 33 and the partial side edge of the hairbrush 32 are in contact with the bottom side of the ion-bar body 10.

During the performance of automatic clean, first, moisturizing the flexible absorbing brush 33, and then the brush assembly 30 wipes the bottom side of the ion-bar body 10 to remove most of the dust. Next, the flexible absorbing brush 33 performs the following cleaning and brushing. The efficiency and quality of cleaning can be enhanced.

The flexible absorbing brush 33 includes a second internal shaft and a sponge absorb layer covering the second internal shaft. Please refer to FIG. 2, the hairbrush 32 includes a first internal shaft 321, a flexible layer 322 fixed on the first internal shaft 321, a hair body 323 on the flexible layer 322, and a plurality of hairs 324 attached to the hair body. The first internal shaft 321 is coaxially fixed ono the rotating shaft of the first motor 31. The flexible layer 322 is made of an elastic rubber layer. The hair body 323 is used to fix the plurality of hairs.

The ion-bar structure with self-cleaning function provided of the present disclosure achieves automatic clean applied on the ion-bar body, thus the underside of the ion-bar body is prevent from excessive stuck dust.

In above-mentioned embodiments, each embodiments focus on different aspects. Some detail part which has not described in the embodiment can take other embodiments as examples.

The ion-bar structure with self-cleaning function provided by the embodiment of the present disclosure is described in detail. In this disclosure, a specific example is applied to explain the principle and implementing method of the present disclosure. The description of the above-mentioned embodiments is only for understanding the technical solutions and core concepts the present disclosure. A skilled person in the art should understand that it can still modify the technical solutions described in the above-mentioned embodiments can still be modified or equivalently substitute some of the technical features. The modifications and substitutions do not lead the corresponding features far from the scopes of each of the embodiments of the present disclosure.

What is claimed is:

1. An ion-bar structure with a self-cleaning function, comprising an ion-bar body, a slide assembly, and a brush assembly;

wherein a slide track is disposed on the ion-bar body along a direction of an shaft of the ion-bar body, the slide assembly is disposed on the slide track, the slide assembly automatically slidable along the slide track, the brush assembly is connected to the slide assembly in order to move with the slide assembly, and the brush assembly is contacted with a bottom of the ion-bar body;

wherein the slide track is disposed on a side wall of the ion-bar body;

wherein the brush assembly comprises a first motor and a hairbrush;

wherein the hairbrush comprises a first internal shaft, a flexible layer fixedly covering on the first internal shaft, a hair body covering on the flexible layer, and hairs disposed on the hair body.

2. The ion-bar structure with self-cleaning function according to claim 1, wherein the first motor is contacted and fixed with the slide assembly, the hairbrush is disposed on a rotation shaft of the first motor, parts of an edge of the hairbrush is contacted with the bottom of the ion-bar body.

3. The ion-bar structure with self-cleaning function according to claim 2, wherein a shape of the hairbrush is round-disk.

4. The ion-bar structure with self-cleaning function according to claim 2, further comprising a dust-rid adhesive pad assembly disposed under the brush assembly.

5. The ion-bar structure with self-cleaning function according to claim 4, wherein the dust-rid adhesive pad assembly comprises a support and a dust-rid adhesive connected to the support, wherein the support is connected to a shell of the first motor, the dust-rid adhesive pad is located under the hairbrush.

6. The ion-bar structure with self-cleaning function according to claim 1, wherein the slide assembly comprises a block, a wheel disposed at a bottom of the block, and a motor disposed on the block for driving the wheel to roll, and wherein the wheel movably is locked on the slide track.

7. The ion-bar with self-cleaning function according to claim 6, wherein the slide track is a chute slide track.

8. The ion-bar structure with self-cleaning function according to claim 1, wherein the brush assembly comprises a first motor, a hairbrush, and a flexible absorbing brush;

wherein the first motor is contacted and fixed with the slide assembly, the flexible absorbing hair and the hairbrush are disposed on a rotation shaft of the first motor, the hairbrush is disposed at an outer side of the flexible absorbing brush, and parts of edge of the flexible absorbing brush and parts of edge of the hairbrush are contacted with the bottom of the ion-bar body.

9. The ion-bar structure with self-cleaning function according to claim 8, wherein the flexible absorbing brush comprises a second internal shaft and a sponge absorb layer covering the second internal shaft.

10. An ion-bar structure with self-cleaning function, comprising an ion-bar body, a slide assembly and a brush assembly;

wherein a slide track is disposed on the ion-bar body along a direction of an shaft of the ion-bar body, the slide assembly is disposed on the slide track, the slide assembly can automatically slide along the slide track, the brush assembly is connected to the slide assembly in order to move with the slide assembly, the brush assembly is contacted with a bottom of the ion-bar body;

wherein the brush assembly comprises a first motor and a hairbrush;

wherein the hairbrush comprises a first internal shaft, a flexible layer fixedly covering on the first internal shaft, a hair body covering on the flexible layer, and hairs disposed on the hair body.

11. The ion-bar structure with self-cleaning function according to claim 10, wherein the first motor is contacted and fixed with the slide assembly, the hairbrush is disposed on a rotation shaft of the first motor, and parts of an edge of the hairbrush is contacted with the bottom of the ion-bar body.

12. The ion-bar structure with self-cleaning function according to claim 11, wherein a shape of the hairbrush is round-disk.

13. The ion-bar structure with self-cleaning function according to claim 11, further comprising a dust-rid adhesive pad assembly disposed under the brush assembly.

14. The ion-bar structure with self-cleaning function according to claim 13, wherein the dust-rid adhesive pad assembly comprises a support and a dust-rid adhesive connected to the support, wherein the support is connected to a shell of the first motor, the dust-rid adhesive pad locates under the hairbrush.

15. The ion-bar structure with self-cleaning function according to claim 10, wherein the slide assembly comprises a block, a wheel disposed at a bottom of the block, and a motor disposed on the block for driving the wheel to roll, and wherein the wheel movably is locked on the slide track.

16. The ion-bar structure with self-cleaning function according to claim 15, wherein the slide track is a chute slide track.

17. The ion-bar structure with self-cleaning function according to claim 10, wherein the brush assembly comprises a first motor, a hairbrush, and a flexible absorbing brush;

wherein the first motor is contacted and fixed with the slide assembly, the flexible absorbing brush and the hairbrush are disposed on a rotation shaft of the first motor, the hairbrush is disposed at an outer side of the flexible absorbing brush, parts of edge of the flexible absorbing brush and parts of edge of the hairbrush are contacted with the bottom of the ion-bar body.

18. The ion-bar structure with self-cleaning function according to claim 17, wherein the flexible absorbing brush comprises a second internal shaft and a sponge absorb layer covering the second internal shaft.

* * * * *